US008123518B2

(12) United States Patent
Nordberg et al.

(10) Patent No.: US 8,123,518 B2
(45) Date of Patent: Feb. 28, 2012

(54) BURNER FIRING RATE DETERMINATION FOR MODULATING FURNACE

(75) Inventors: Timothy J. Nordberg, Plymouth, MN (US); Brent Chiain, Plymouth, MN (US); Michael W. Schultz, Elk River, MN (US); Douglas D. Bird, Little Canada, MN (US)

(73) Assignee: Honeywell International Inc., Morristown, NJ (US)

( * ) Notice: Subject to any disclaimer, the term of this patent is extended or adjusted under 35 U.S.C. 154(b) by 679 days.

(21) Appl. No.: 12/171,158

(22) Filed: Jul. 10, 2008

(65) Prior Publication Data

US 2010/0009302 A1 Jan. 14, 2010

(51) Int. Cl.

| | |
|---|---|
| ***F23N 1/02*** | (2006.01) |
| ***F23N 5/00*** | (2006.01) |
| ***F24H 9/20*** | (2006.01) |
| ***F24H 3/02*** | (2006.01) |

(52) U.S. Cl. ..... 431/12; 431/75; 236/10; 236/11; 126/110 A; 126/116 A

(58) Field of Classification Search ..... 236/10, 236/11; 431/12, 75; 126/116 A, 110 A, 110
See application file for complete search history.

(56) References Cited

U.S. PATENT DOCUMENTS

| | | | |
|---|---|---|---|
| 4,251,025 | A | 2/1981 | Bonne et al. |
| 4,314,441 | A | 2/1982 | Yannone et al. |
| 4,329,138 | A | 5/1982 | Riordan |
| 4,334,855 | A | 6/1982 | Nelson |
| 4,340,355 | A | 7/1982 | Nelson et al. |
| 4,373,897 | A | 2/1983 | Torborg |
| 4,439,139 | A | 3/1984 | Nelson et al. |
| 4,502,625 | A | 3/1985 | Mueller |
| 4,533,315 | A | 8/1985 | Nelson |
| 4,684,060 | A | 8/1987 | Adams et al. |
| 4,688,547 | A | 8/1987 | Ballard et al. |
| 4,703,795 | A | 11/1987 | Beckey |
| 4,708,636 | A | 11/1987 | Johnson |
| 4,729,207 | A | 3/1988 | Dempsey et al. |
| 4,767,104 | A | 8/1988 | Plesinger et al. |
| 4,819,587 | A | 4/1989 | Tsutsui et al. |
| 4,892,245 | A | 1/1990 | Dunaway et al. |
| 4,915,615 | A | 4/1990 | Kawamura et al. |
| 5,026,270 | A | 6/1991 | Adams et al. |
| 5,248,083 | A | 9/1993 | Adams et al. |
| 5,307,990 | A | 5/1994 | Adams et al. |
| 5,331,944 | A | 7/1994 | Kujawa et al. |

(Continued)

OTHER PUBLICATIONS

Honeywell, "45.801.175, Amplification Gas/Air Module for VK4105R/VK8105R Gas Controls," Production Handbook, 8 pages, prior to Oct. 18, 2006.

(Continued)

*Primary Examiner* — Kenneth Rinehart
*Assistant Examiner* — William Corboy
(74) *Attorney, Agent, or Firm* — Seager Tufte & Wickhem LLC

(57) ABSTRACT

A modulating furnace having a variable rate burner and a controller is operated at a first burner firing rate for a first period of time, and a higher burner firing rate once the first period of time has expired. In some instances, the burner may be operated only while the controller is receiving a call for heat from a thermostat or the like.

13 Claims, 12 Drawing Sheets

U.S. PATENT DOCUMENTS

| | | | | |
|---|---|---|---|---|
| 5,340,028 | A | 8/1994 | Thompson | |
| 5,347,981 | A | 9/1994 | Southern et al. | |
| 5,408,986 | A | 4/1995 | Bigham | |
| 5,520,533 | A | 5/1996 | Vrolijk | |
| 5,590,642 | A | 1/1997 | Borgeson et al. | |
| 5,630,408 | A | 5/1997 | Versluis | |
| 5,720,231 | A | 2/1998 | Rowlette et al. | |
| 5,732,691 | A | 3/1998 | Maiello et al. | |
| 5,791,332 | A | 8/1998 | Thompson et al. | |
| 5,806,440 | A | 9/1998 | Rowlette et al. | |
| 5,819,721 | A | 10/1998 | Carr et al. | |
| 5,860,411 | A | 1/1999 | Thompson et al. | |
| 5,865,611 | A | 2/1999 | Maiello | |
| 5,993,195 | A | 11/1999 | Thompson | |
| 6,000,622 | A | 12/1999 | Tonner et al. | |
| 6,109,255 | A | 8/2000 | Dieckmann et al. | |
| 6,254,008 | B1 | 7/2001 | Erickson et al. | |
| 6,257,870 | B1 | 7/2001 | Hugghins et al. | |
| 6,283,115 | B1 | 9/2001 | Dempsey et al. | |
| 6,321,744 | B1 | 11/2001 | Dempsey et al. | |
| 6,354,327 | B1 | 3/2002 | Mayhew | |
| 6,377,426 | B2 | 4/2002 | Hugghins et al. | |
| 6,571,817 | B1 | 6/2003 | Bohan, Jr. | |
| 6,705,533 | B2 | 3/2004 | Casey et al. | |
| 6,749,423 | B2 | 6/2004 | Fredricks et al. | |
| 6,758,909 | B2 | 7/2004 | Jonnalagadda et al. | |
| 6,764,298 | B2 | 7/2004 | Kim et al. | |
| 6,793,015 | B1 | 9/2004 | Brown et al. | |
| 6,846,514 | B2 | 1/2005 | Jonnalagadda et al. | |
| 6,866,202 | B2 | 3/2005 | Sigafus et al. | |
| 6,880,548 | B2 | 4/2005 | Schultz et al. | |
| 6,918,756 | B2 | 7/2005 | Fredricks et al. | |
| 6,923,643 | B2 | 8/2005 | Schultz et al. | |
| 6,925,999 | B2 | 8/2005 | Hugghins et al. | |
| 7,055,759 | B2 | 6/2006 | Wacker et al. | |
| 7,101,172 | B2 | 9/2006 | Jaeschke | |
| 7,111,503 | B2 | 9/2006 | Brumboiu et al. | |
| 7,293,718 | B2 * | 11/2007 | Sigafus et al. | 236/11 |
| 2002/0155404 | A1 | 10/2002 | Casey et al. | |
| 2002/0155405 | A1 | 10/2002 | Casey et al. | |
| 2003/0011342 | A1 | 1/2003 | Eichorn | |
| 2005/0159844 | A1 | 7/2005 | Sigafus et al. | |
| 2006/0105279 | A1 | 5/2006 | Munsterhuis et al. | |
| 2007/0090198 | A1 * | 4/2007 | Hugghins | 236/46 E |

OTHER PUBLICATIONS

Honeywell, "VK41..R/VK81..R Series, Gas Controls with Integrated Gas/Air Module for Combined Valve and Ignition System," Instruction Sheet, 6 pages, prior to Oct. 18, 2006.

http://www.regal-beloit.com/gedraft.html, "Welcome to GE Commercial Motors by Regal-Beloit," 1 page, printed Apr. 26, 2006.

Lennox, "G61MPV Series Units," Installation Instructions, 2 pages, Oct. 2006.

* cited by examiner

BURNER FIRING RATE DETERMINATION FOR MODULATING FURNACE

TECHNICAL FIELD

The disclosure relates generally to furnaces such as modulating furnaces.

BACKGROUND

Many homes and other buildings rely upon furnaces to provide heat during cool and/or cold weather. Typically, a furnace employs a burner that burns a fuel such as natural gas, propane, oil or the like, and provides heated combustion gases to the interior of a heat exchanger. The combustion gases typically proceed through the heat exchanger, are collected by a collector box, and then are exhausted outside of the building via a vent or the like. In some cases, a combustion blower is provided to pull in combustion air into the burner, pull the combustion gases through the heat exchanger into the collector box, and to push the combustion gases out the vent. At the same time, a circulating blower typically forces return air from the building, and in some cases ventilation air from outside of the building, over or through the heat exchanger, thereby heating the air. The heated air is subsequently routed throughout the building via a duct system. A return duct is typically employed to return air from the building to the furnace to be re-heated and then re-circulated.

In order to provide improved energy efficiency and/or occupant comfort, some furnaces may be considered as having two or more stages, i.e., they can operate at two or more different burner firing rates, depending on how much heat is needed within the building. Some furnaces are known as modulating furnaces, because they can potentially operate at a number of different burner firing rates and/or across a range of burner firing rates. The burner firing rate of the furnace typically dictates the amount of gas and air that is required by the burner. The circulating blower may be regulated, in accordance with the burner firing rate, to maintain a desired discharge air temperature, i.e., the temperature of the heated air returning to the building. A need remains for improved methods of determining burner firing rates.

SUMMARY

The disclosure pertains generally to methods of operating modulating combustion appliances such as forced air furnaces. An illustrative but non-limiting example of the disclosure may be found in a method of operating a modulating furnace having a burner that is configured to operate at variable burner firing rates and a controller that is configured to accept a call for heat from a thermostat or the like. The call for heat may remain activate until the call is satisfied, at which time the call may be terminated by the thermostat or the like, resulting in a heating cycle. This may be repeated during operation of the modulating furnace.

In some instances, the burner may be operated at a first burner firing rate for a first period of time. After the first period of time has expired, the burner firing rate may be increased. In some instances, the burner firing rate may be increased in accordance with a predetermined function, such as a linear function, a piecewise linear function, a step-wise function that includes a single or multiple steps, an exponential function, any combination of these functions, or any other suitable function, as desired. In some instances, the burner may be operated only while the controller is receiving a call for heat from the thermostat or the like, but this is not required in all embodiments.

The initial burner firing rate for each heating cycle may be a fixed value, such as a predetermined minimum burner firing rate (e.g. 40%). Alternatively, the initial burner firing rate may vary for each heating cycle. When the initial burner firing rate may vary for each of the heating cycles, it is contemplated that the initial burner firing rate may be based, at least in part, on historical operating parameters of the modulating furnace. For example, the initial burner firing rate may be based, at least in part, on the "off" time of the burner during one or more previous heating cycles or over a previous period of time (e.g. 1 hour), the run-time of the burner during one or more previous heating cycles or over a previous period of time, and/or the burner firing rate that existed at the end of the previous heating cycle.

In some cases, the initial burner firing rate may be based, at least in part, on a weighed set or weighted average of one or more current and/or historical operating parameters of the modulating furnace. For example, the initial burner firing rate may be based, at least in part, on the average duty cycle of the modulating furnace during one or more previous heating cycles or over a predetermined period of time, a weighted set or weighted average of the burner firing rates over one or more previous heating cycles or over a predetermined period of time, a weighed set or weighted average of a predefined minimum burner firing rate and one or more previous burner firing rates. These, however, are merely illustrative.

Another illustrative but non-limiting example of the disclosure may be found in a method of operating a forced air furnace that includes a variable rate burner and a controller that is configured to accept signals from a two-stage thermostat. The controller may define a first stage ON parameter based at least in part on a length of time that a W1 (First Stage Heat) ON signal is received from the two-stage thermostat. A second stage ON parameter may be defined based at least in part on a length of time that a W2 (second Stage Heat) ON signal is received from the two-stage thermostat. A burner firing rate for a current heating cycle may be determined, relying at least in part on the first stage ON parameter and/or the second stage ON parameter. For example, the burner firing rate may be set to an initial burner firing rate for a period of time, after which the burner firing rate may be increased if the W2 (second Stage Heat) ON signal remains active. In some cases, the longer the W2 (second Stage Heat) ON signal remains active, the more the burner firing rate may be increased. The initial burner firing rate may be a fixed value, or may vary for each heating cycle, as described above.

The above summary is not intended to describe each disclosed embodiment or every implementation. The Figures, Description and Examples which follow more particularly exemplify these embodiments.

BRIEF DESCRIPTION

The disclosure may be more completely understood in consideration of the following detailed description of various embodiments in connection with the accompanying drawings, in which.

Figure 1:
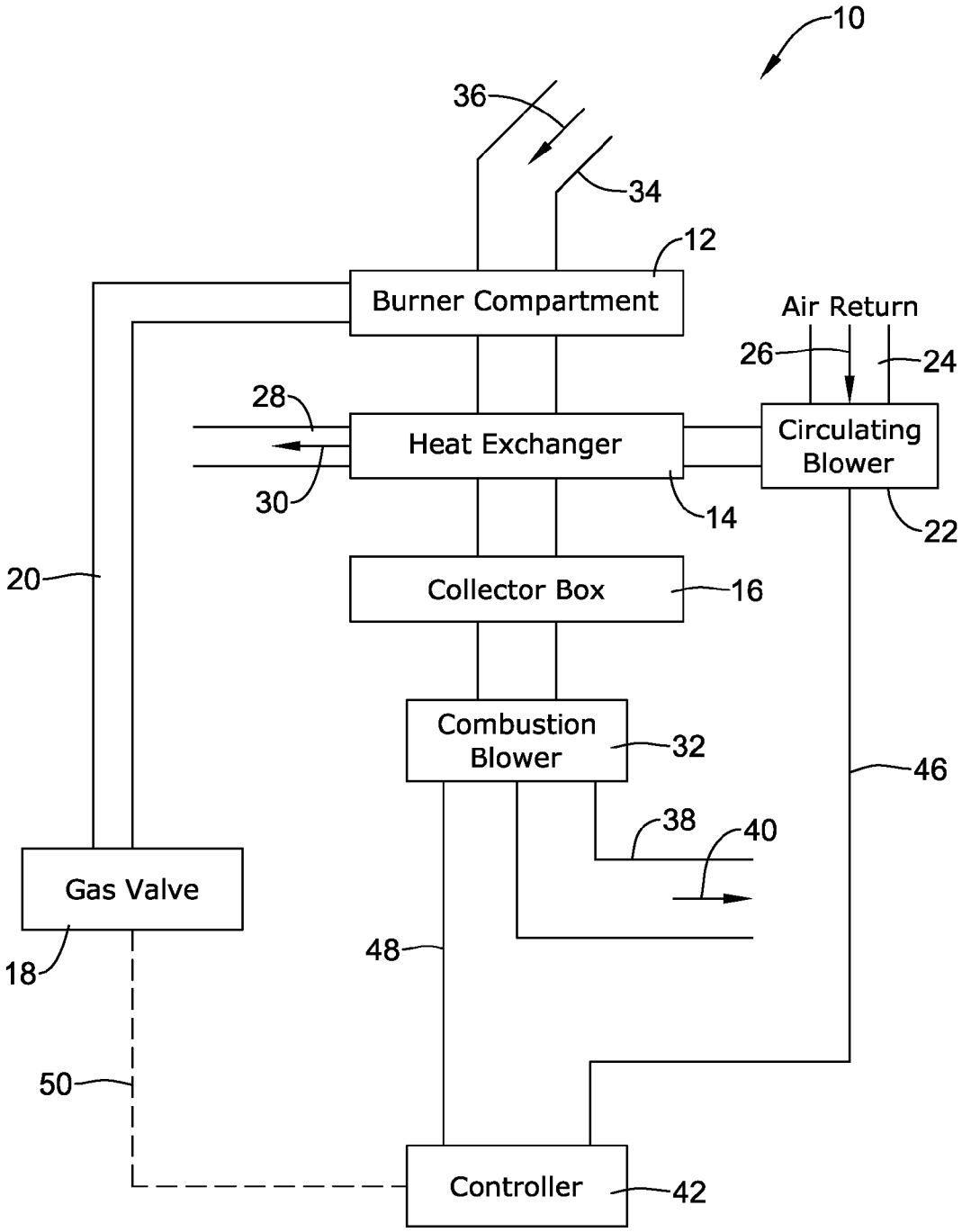
FIG. 1 is a schematic view of an illustrative but non-limiting furnace.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

FIG. 1 is a schematic view of a furnace 10, which may include additional components not described herein. The primary components of furnace 10 include a burner compartment 12, a heat exchanger 14 and a collector box 16. An electrically or pneumatically regulated gas valve 18 provides fuel such as natural gas or propane, from a source (not illustrated) to burner compartment 12 via a gas line 20. Burner compartment 12 burns the fuel provided by gas valve 18, and provides heated combustion products to heat exchanger 14. The heated combustion products pass through heat exchanger 14 and exit into collector box 16, and are ultimately exhausted to the exterior of the building or home in which furnace 10 is installed.

In the illustrative furnace, a circulating blower 22 accepts return air from the building or home's return ductwork 24 as indicated by arrow 26 and blows the return air through heat exchanger 14, thereby heating the air. The heated air exits heat exchanger 14 and enters the building or home's conditioned air ductwork 28, traveling in a direction indicated by arrow 30. For enhanced thermal transfer and efficiency, the heated combustion products may pass through heat exchanger 14 in a first direction while circulating blower 22 forces air through heat exchanger 14 in a second direction. In some instances, for example, the heated combustion products may pass generally downwardly through heat exchanger 14 while the air blown through by circulating blower 22 may pass upwardly through heat exchanger 14, but this is not required.

In some cases, as illustrated, a combustion blower 32 may be positioned downstream of collector box 16 and may pull combustion gases through heat exchanger 14 and collector box 16. Combustion blower 32 may be considered as pulling combustion air into burner compartment 12 through combustion air source 34 to provide an oxygen source for supporting combustion within burner compartment 12. The combustion air may move in a direction indicated by arrow 36. Combustion products may then pass through heat exchanger 14, into collector box 16, and ultimately may be exhausted through the flue 38 in a direction indicated by arrow 40.

Furnace 10 may include a controller 42 that can be configured to control various components of furnace 10, including the ignition of fuel by an ignition element (not shown), the speed and operation times of combustion blower 32, and the speed and operation times of circulating fan or blower 22. In addition, controller 42 can be configured to monitor and/or control various other aspects of the system including any damper and/or diverter valves connected to the supply air ducts, any sensors used for detecting temperature and/or airflow, any sensors used for detecting filter capacity, and any shut-off valves used for shutting off the supply of gas to gas valve 18. In the control of other gas-fired appliances such as water heaters, for example, controller 42 can be tasked to perform other functions such as water level and/or temperature detection, as desired.

In some embodiments, controller 42 can include an integral furnace controller (IFC) configured to communicate with one or more thermostats or the like (not shown) for receiving calls for heat, sometimes from various locations within the building or structure. It should be understood, however, that controller 42 may be configured to provide connectivity to a wide variety of platforms and/or standards, as desired.

Controller 42 may provide commands to circulating blower 22 via an electrical line 46. In some cases, controller 42 may also regulate combustion blower 32 via signals sent via an electrical line 48. In some instances, controller 42 may indirectly regulate the flow of gas through gas valve 18 by electrically commanding combustion blower 32 to increase or decrease its speed. The resulting change in combustion gas flow through one or more of burner compartment 12, heat exchanger 14, collector box 16 and combustion blower 32 may be detected and/or measured pneumatically as a pressure or as a pressure drop. The pressure signal may be used to pneumatically regulate gas valve 18, although the pneumatic line(s) is (are) not illustrated in FIG. 1. In some instances, it is contemplated that controller 42 may electrically control gas valve 18 by sending appropriate command signals via an optional electrical line 50.

Figure 2:
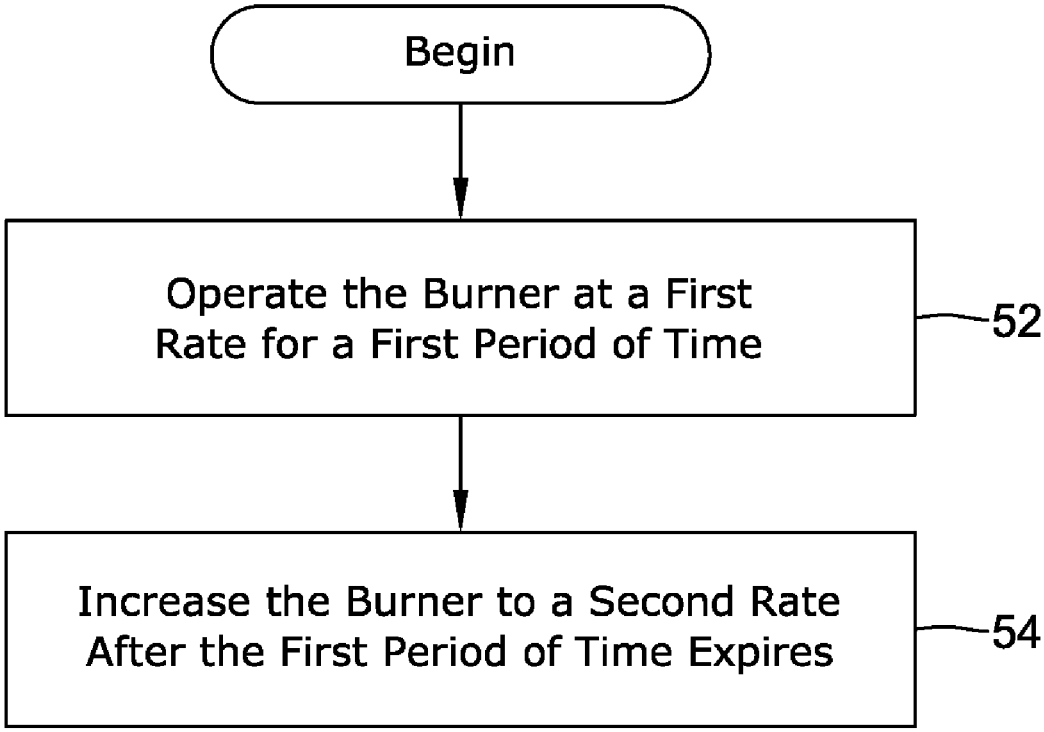
FIGS. 2 through 12 are flow diagrams showing illustrative but non-limiting methods that may be carried out using the furnace of FIG. 1.

FIGS. 2 through 12 are flow diagrams showing illustrative but non-limiting methods that may be carried out using furnace 10 (FIG. 1). In FIG. 2, control begins at block 52, at which controller 42 (FIG. 1) operates burner 12 (FIG. 1) at a first burner firing rate for a first period of time. The first period of time may, for example, be a selectable parameter that can be adjusted by an installer or the like. In some cases, this parameter may also be software settable via controller 42. In some instances the first burner firing rate may be an initial burner firing rate. The initial burner firing rate may, for each heating cycle of the furnace 10, be set to a fixed value such as a predetermined minimum burner firing rate (e.g. 40%). Alternatively, the initial burner firing rate may vary for each heating cycle.

When the initial burner firing rate may vary for each of the heating cycles, it is contemplated that the initial burner firing rate may be based, at least in part, on historical operating parameters of the furnace 10. For example, the initial burner firing rate may be based, at least in part, on the "off" time of the burner during one or more previous heating cycles or over a previous period of time (e.g. 1 hour), the run-time of the burner during one or more previous heating cycles or over a previous period of time, and/or the burner firing rate that existed at the end of the previous heating cycle.

In some instances, the initial burner firing rate may be based, at least in part, on a weighed set or weighted average of one or more current and/or historical operating parameters of the furnace 10. For example, the initial burner firing rate may be based, at least in part, on the average duty cycle of the furnace 10 during one or more previous heating cycles or over a predetermined period of time, a weighted set or weighted average of the burner firing rates over one or more previous heating cycles or over a predetermined period of time, a weighed set or weighted average of a predefined minimum burner firing rate and one or more previous burner firing rates. These, however, are merely illustrative.

At block 54, controller 42 increases the firing rate of burner 12 after the first period of time has expired, such as to a second burner firing rate. The second burner firing rate may be determined in a step-wise fashion and/or may be ramped up, i.e., increasing the burner firing rate by a particular amount or percentage per unit time. In some instances, the burner firing rate may be increased in accordance with any predetermined function, such as a linear function, a piecewise linear function, a step-wise function that includes a single or multiple steps, an exponential function, any combination of these functions, or any other suitable function, as desired.

In some instances, burner 12 may be permitted to operate while controller 42 is receiving a call for heat (from a thermostat or similar device, not shown) but is stopped when the call for heat ceases. In some cases, for example, a call for heat may mean that controller 42 is receiving a call for heat from a single stage thermostat. In other cases, a call for heat may mean that controller 42 is receiving a W (first stage heat) ON signal and/or a W2 (second stage heat) ON signal from a two stage thermostat. These, however, are only illustrative, and it is contemplated that a call for heat may emanate from any suitable device.

Figure 3:
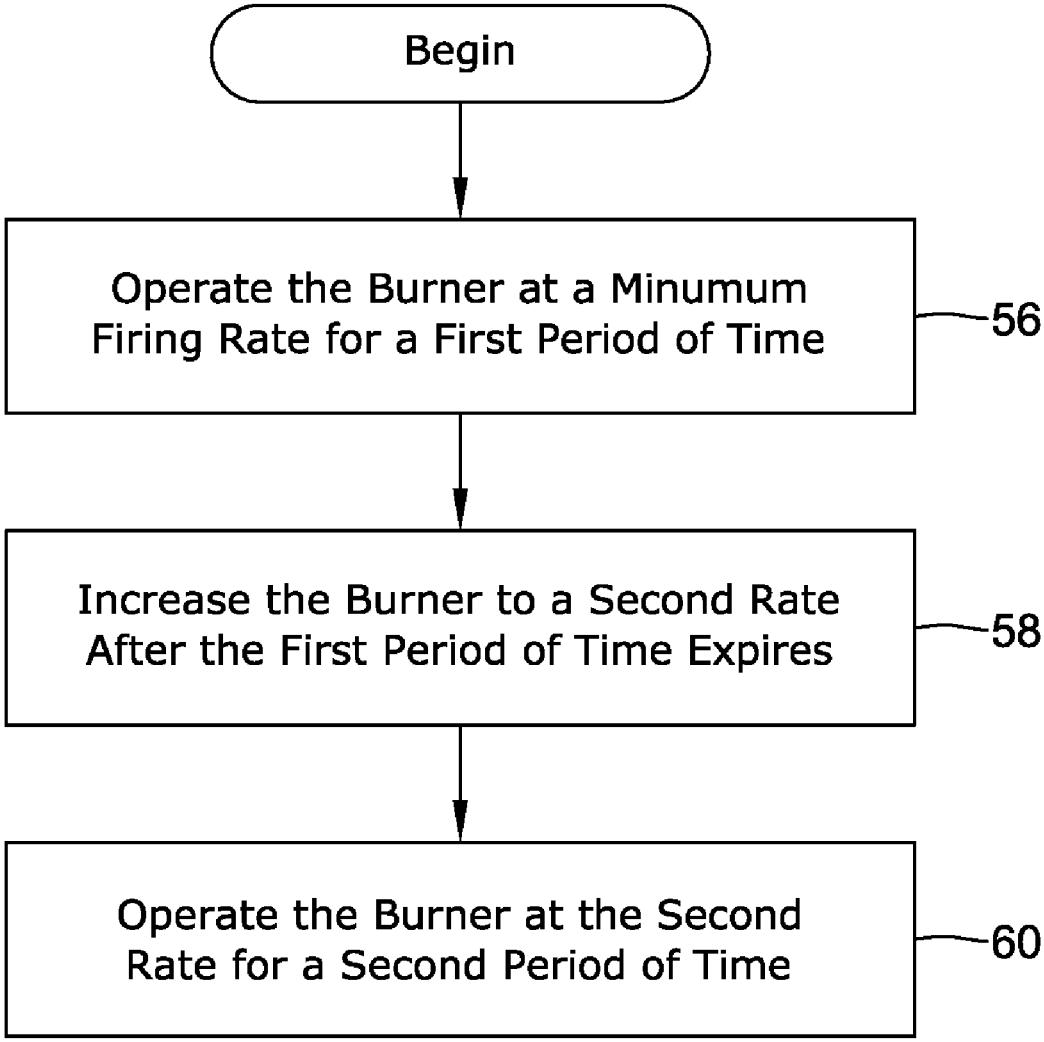

Turning now to FIG. 3, control begins at block 56, where controller 42 (FIG. 1) operates burner 12 (FIG. 1) at a minimum burner firing rate for a first period of time. At block 58, controller 42 increases burner 12 to a second burner firing rate after the first period of time has expired. The second burner firing rate may be determined in a step-wise fashion, by ramping the burner firing rate, or by any other suitable function, as desired. Controller 42 may operate burner 12 at the second rate for a second period of time, as shown at block 60. The second period of time may be a user-determined parameter and/or an installation-specific setting that is determined and set by an installer. Alternatively, the second period of time may be determined by the controller, and in some cases, may be based on one or more historical operating parameters of the furnace.

Figure 4:
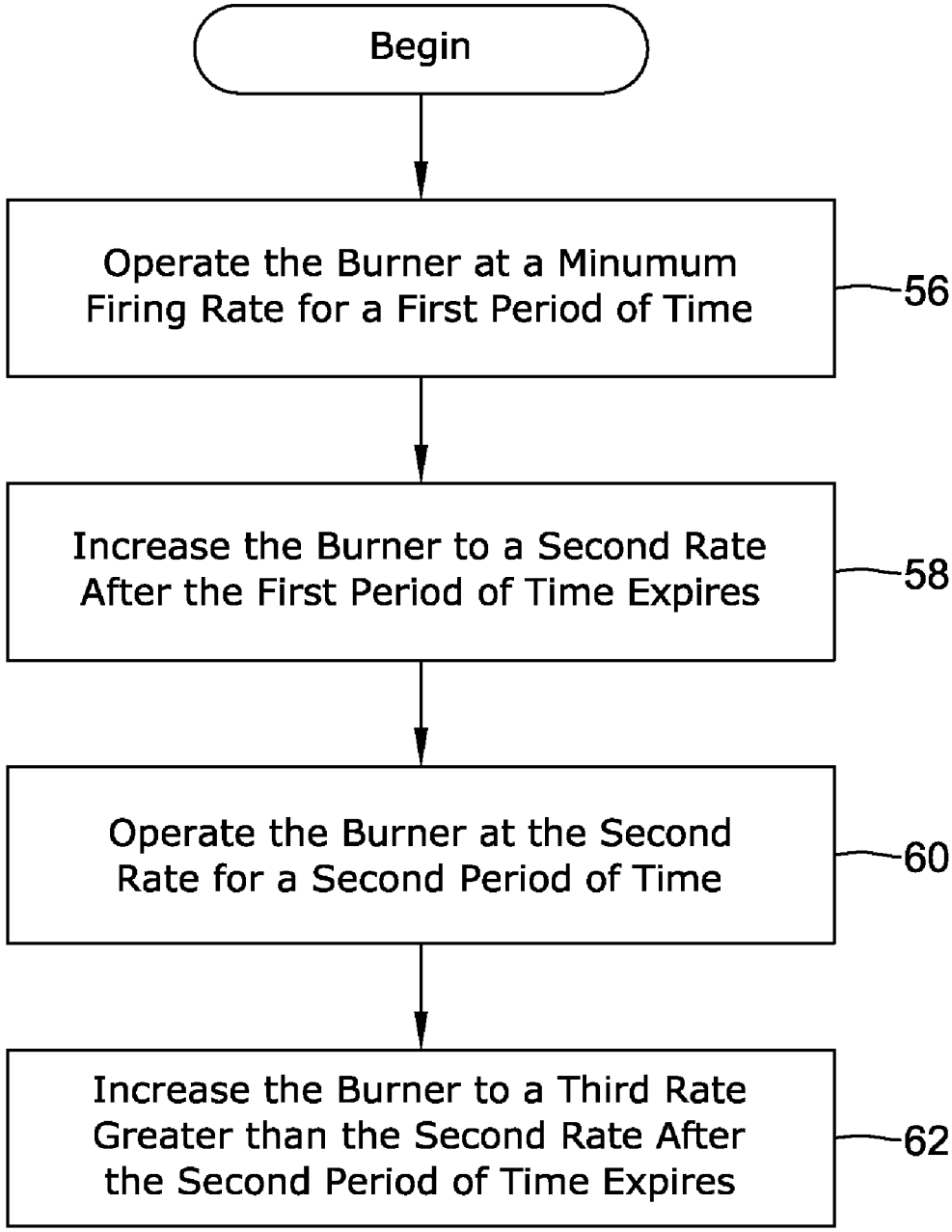

Turning now to FIG. 4, control begins at block 56, where controller 42 (FIG. 1) operates burner 12 (FIG. 1) at a minimum burner firing rate for a first period of time. At block 58, controller 42 increases burner 12 to a second burner firing rate after the first period of time has expired. Controller 42 may operate burner 12 at the second burner firing rate for a second period of time, as referenced at block 60. Control passes to block 62, where controller 42 increases burner 12 to a third burner firing rate after the second period of time has expired. The third burner firing rate may be greater than the second burner firing rate, but this is not required in all embodiments. In some cases, the third burner firing rate may be a maximum fire rate.

Figure 5:
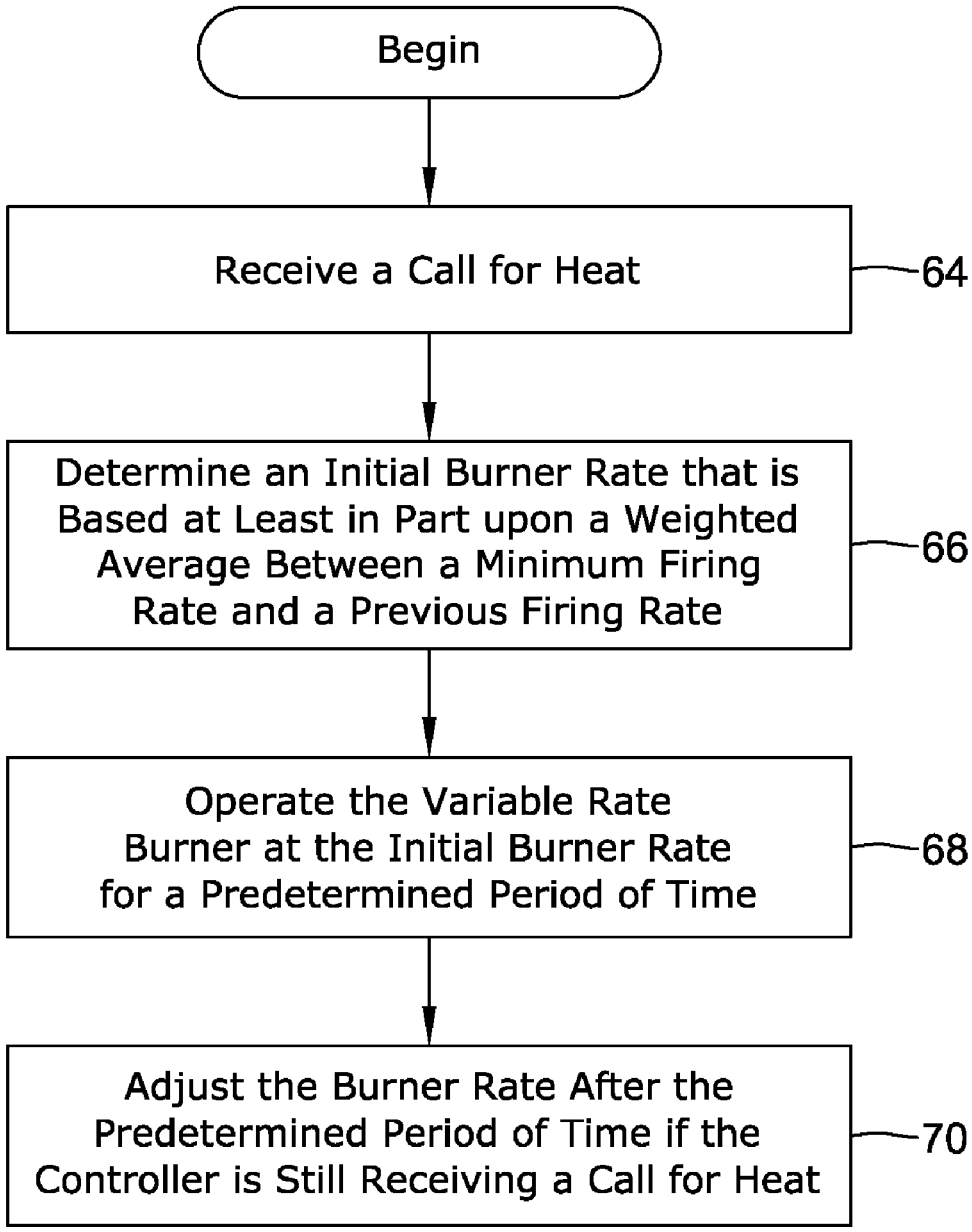

In FIG. 5, control begins at block 64, where controller 42 (FIG. 1) receives a call for heat from a thermostat or the like. Control passes to block 66, where controller 42 determines an initial burner firing rate that is based at least in part on a weighted average between a minimum burner firing rate and a previous burner firing rate. This is only illustrative, and it is contemplated that any suitable method, including those discussed above, may be used to determine the initial burner firing rate. At block 68, burner 12 (FIG. 1) is operated at the initial burner firing rate for a predetermined period of time. Control passes to block 70, where controller 42 adjusts the burner firing rate of burner 12 after the predetermined period of time expires if controller 42 is still receiving the call for heat.

Figure 6:
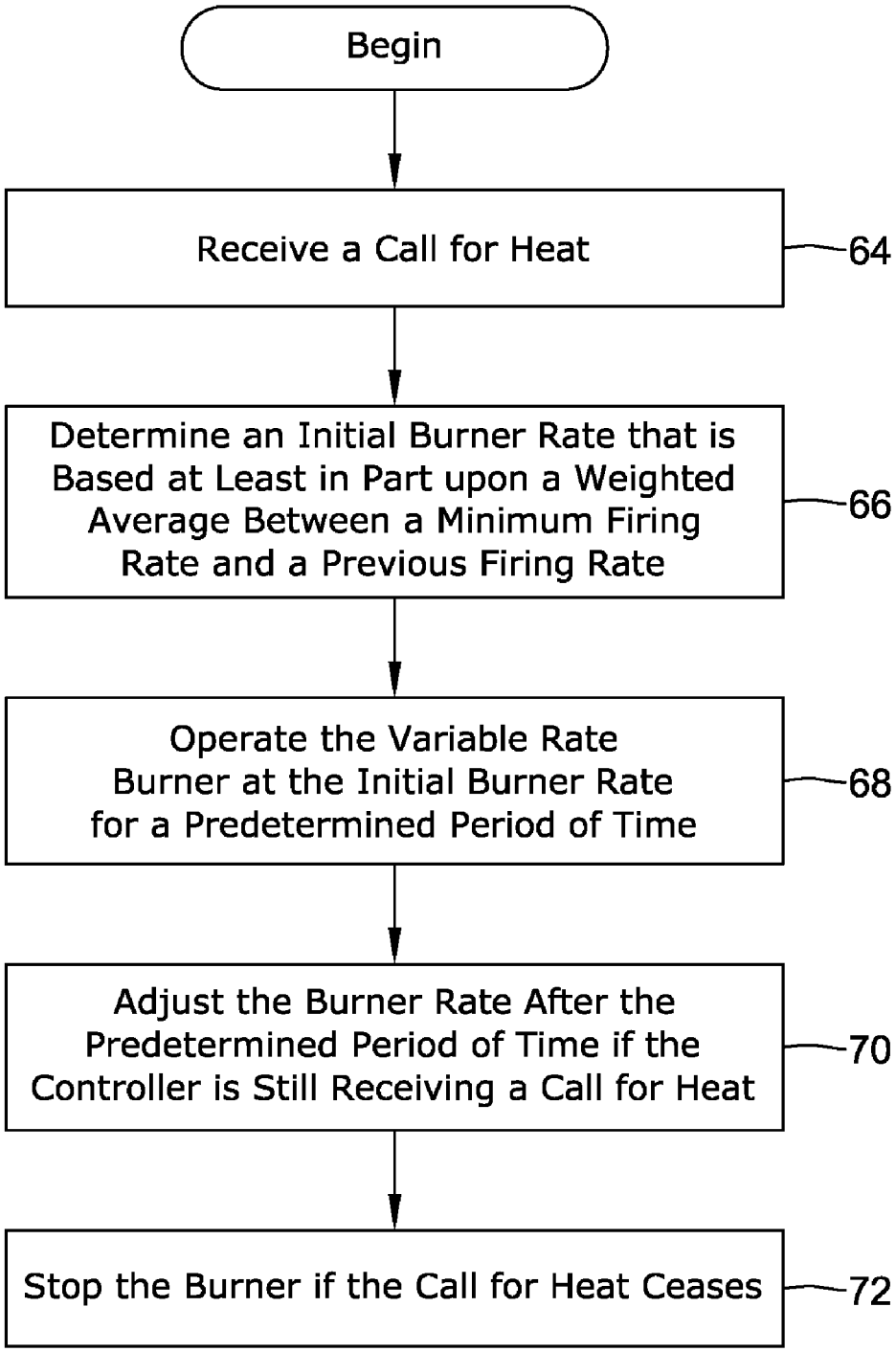

In FIG. 6, control begins at block 64, where controller 42 (FIG. 1) receives a call for heat from a thermostat or the like. Control passes to block 66, where controller 42 determines an initial burner firing rate that is based at least in part on a weighted average between a minimum burner firing rate and a previous burner firing rate. Again, this is only illustrative, and it is contemplated that any suitable method, including those discussed above, may be used to determine the initial burner firing rate. At block 68, burner 12 (FIG. 1) is operated at the initial burner firing rate for a predetermined period of time. Control passes to block 70, where controller 42 adjusts the burner firing rate of burner 12 after the predetermined period of time expires if controller 42 is still receiving a call for heat.

At block 72, controller 42 stops burner 12 if the call for heat stops. While block 72 is shown in FIG. 6 at the end of the flow diagram, it will be appreciated that in some cases controller 42 can cease burner operation at any suitable point during the flow diagram. For example, if controller 42 recognizes that the call for heat has stopped even while controller 42 is in the process of carrying out the steps outlined in block 66, block 68 and/or block 70, controller 42 may immediately stop burner operation. If gas valve 18 (FIG. 1) is electrically controlled, appropriate instructions may be sent via electrical line 50 (FIG. 1) to cease burner operation. If gas valve 18 is pneumatically modulated, burner operation may be ceased by reducing the speed of combustion blower 32 (FIG. 1) such that the resultant pressure drop within flue 38 will cause gas valve 18 to stop providing gas to the burner.

Figure 7:
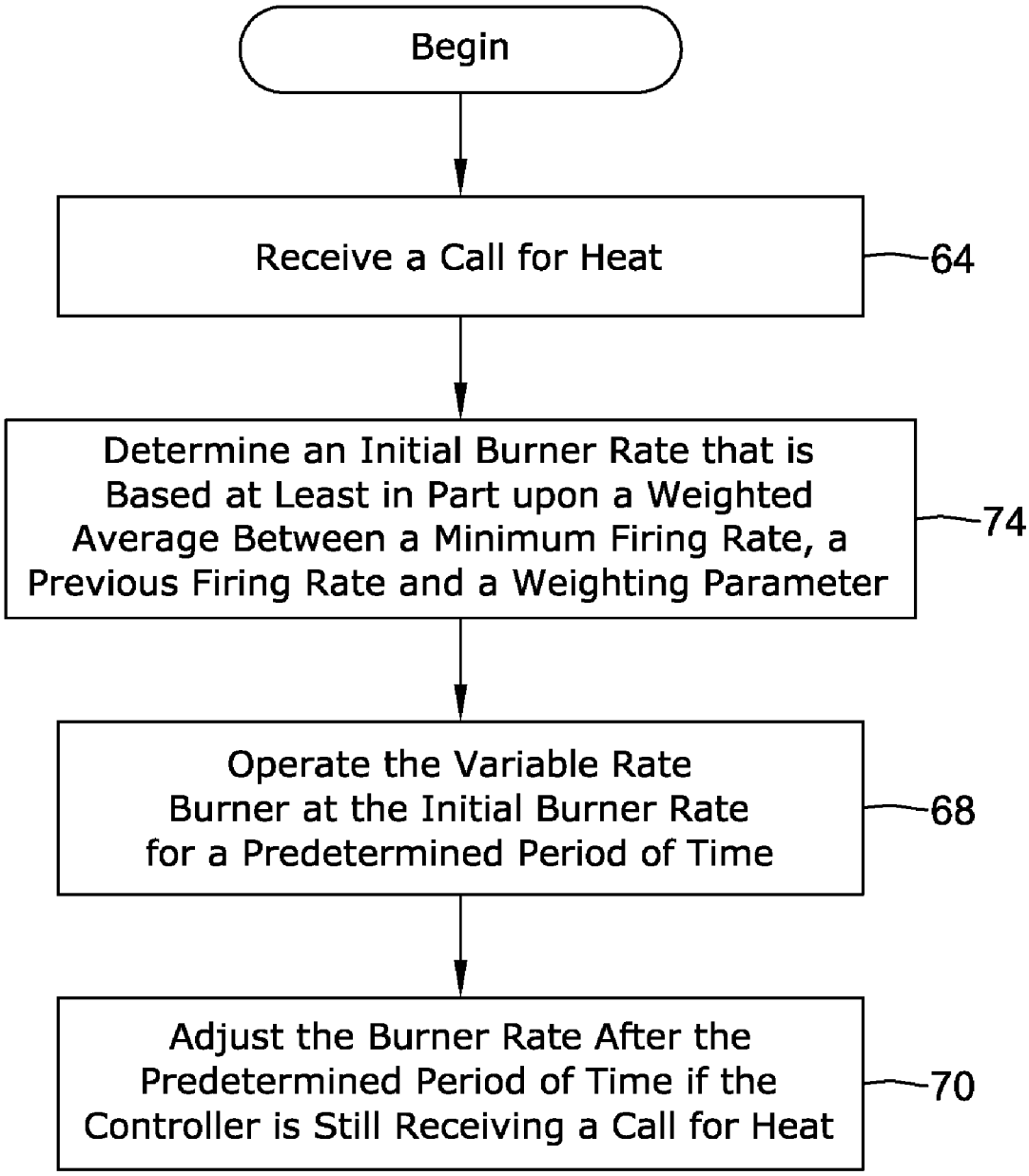

In FIG. 7, control begins at block 64, where controller 42 (FIG. 1) receives a call for heat from a thermostat or the like. At block 74, controller 42 determines an initial burner firing rate that is based at least in part on a weighted average between a minimum burner firing rate and a previous burner firing rate and is also based at least in part on a weighting parameter. In some cases, the weighting parameter may be a function of an Off time during a previous heating cycle, although this is not required. At block 68, burner 12 (FIG. 1) is operated at the initial burner firing rate for a predetermined period of time. Control passes to block 70, where controller 42 adjusts the burner firing rate of burner 12 after the predetermined period of time expires if controller 42 is still receiving a call for heat.

Figure 8:
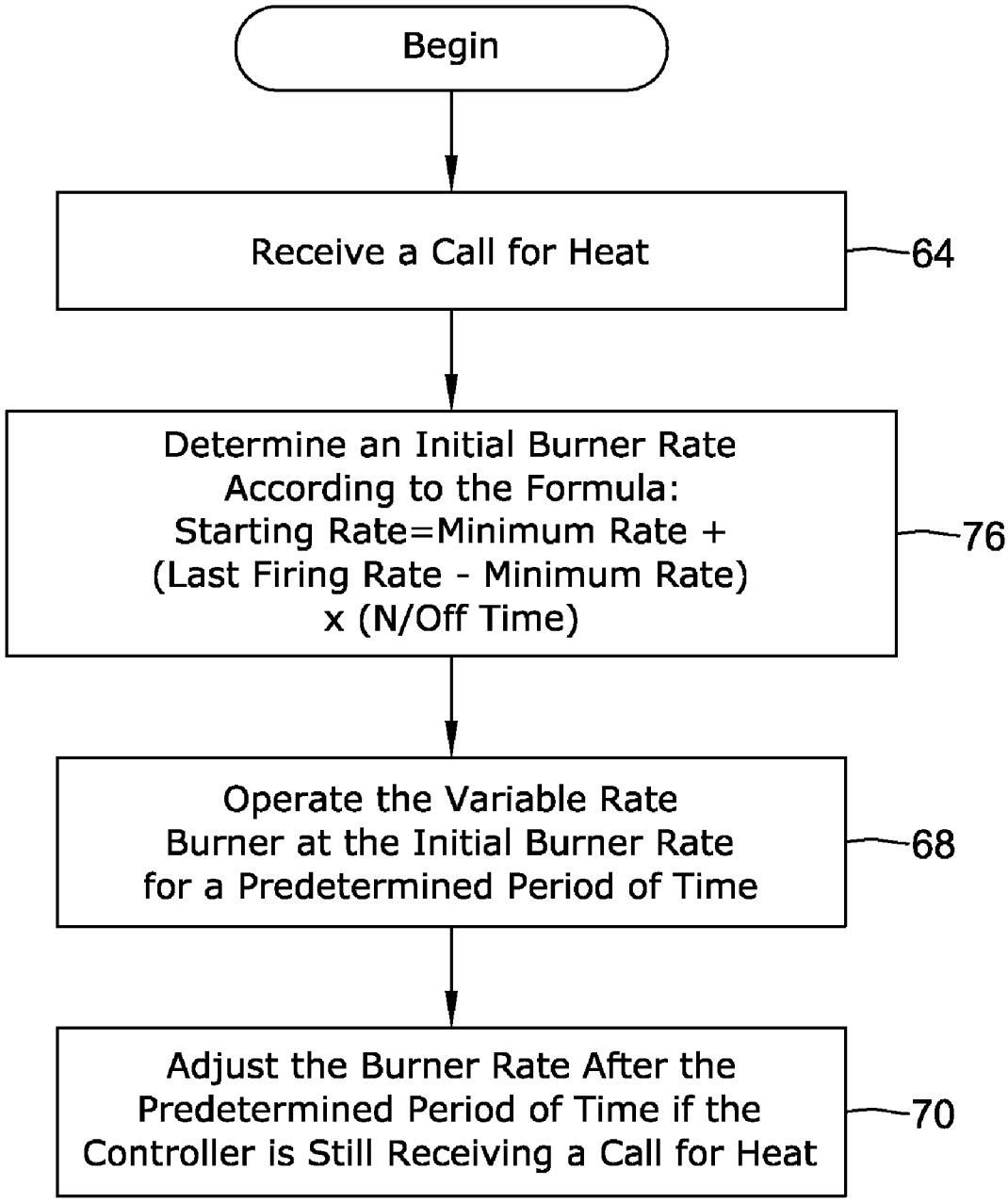

In FIG. 8, control begins at block 64, where controller 42 (FIG. 1) receives a call for heat from a thermostat or the like. At block 76, controller 42 determines an initial burner firing rate according to the formula:

$$StartingRate = MinimumRate + \left(\begin{matrix} LastFiringRate - \\ MinimumRate \end{matrix}\right) * \frac{N}{OffTime},$$

where StartingRate is the initial burner firing rate, MinimumRate is a minimum burner firing rate, LastFiringRate is the previous burner firing rate, OffTime represents how long the burner was off during a previous heating cycle, and N is a parameter that can be adjusted to further weight the StartingRate. In some cases, N may be selected to provide a StartingRate that is close to the minimum fire rate for a chosen OffTime. In an illustrative but non-limiting example, N may be set to five minutes. At block 68, burner 12 (FIG. 1) is operated at the initial burner firing rate for a predetermined period of time. Control passes to block 70, where controller 42 adjusts the burner firing rate of burner 12 after the predetermined period of time expires if controller 42 is still receiving a call for heat.

Figure 9:
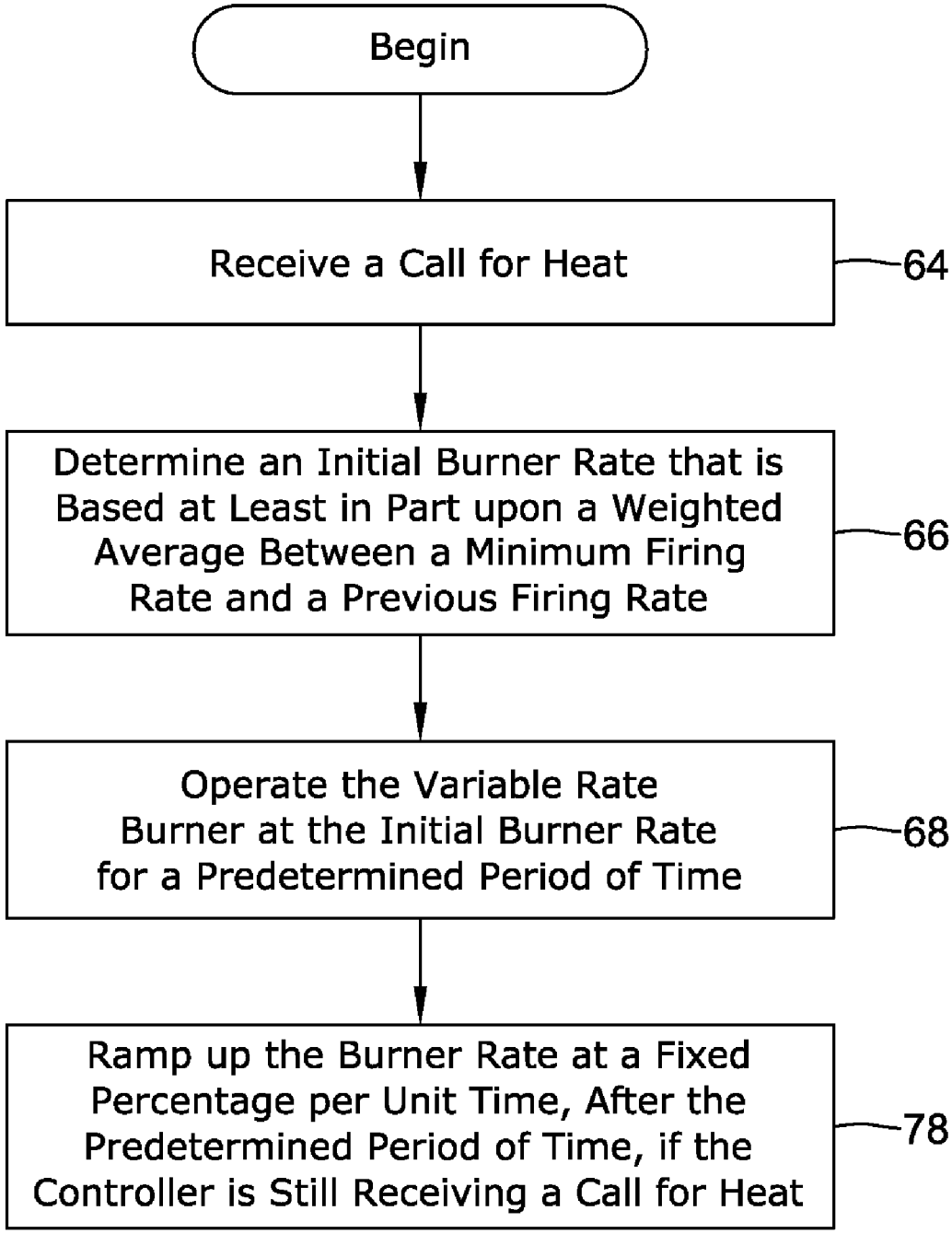

In FIG. 9, control begins at block 64, where controller 42 (FIG. 1) receives a call for heat from a thermostat or the like. Control passes to block 66, where controller 42 determines an initial burner firing rate that is based at least in part on a weighted average between a minimum burner firing rate and a previous burner firing rate. At block 68, burner 12 (FIG. 1) is operated at the initial burner firing rate for a predetermined period of time. Control passes to block 78, where controller 42 ramps up the burner firing rate of burner 12 at a fixed percentage at each of a number of time intervals if, after the predetermined period of time has expired, controller 42 is still receiving a call for heat.

Figure 10:
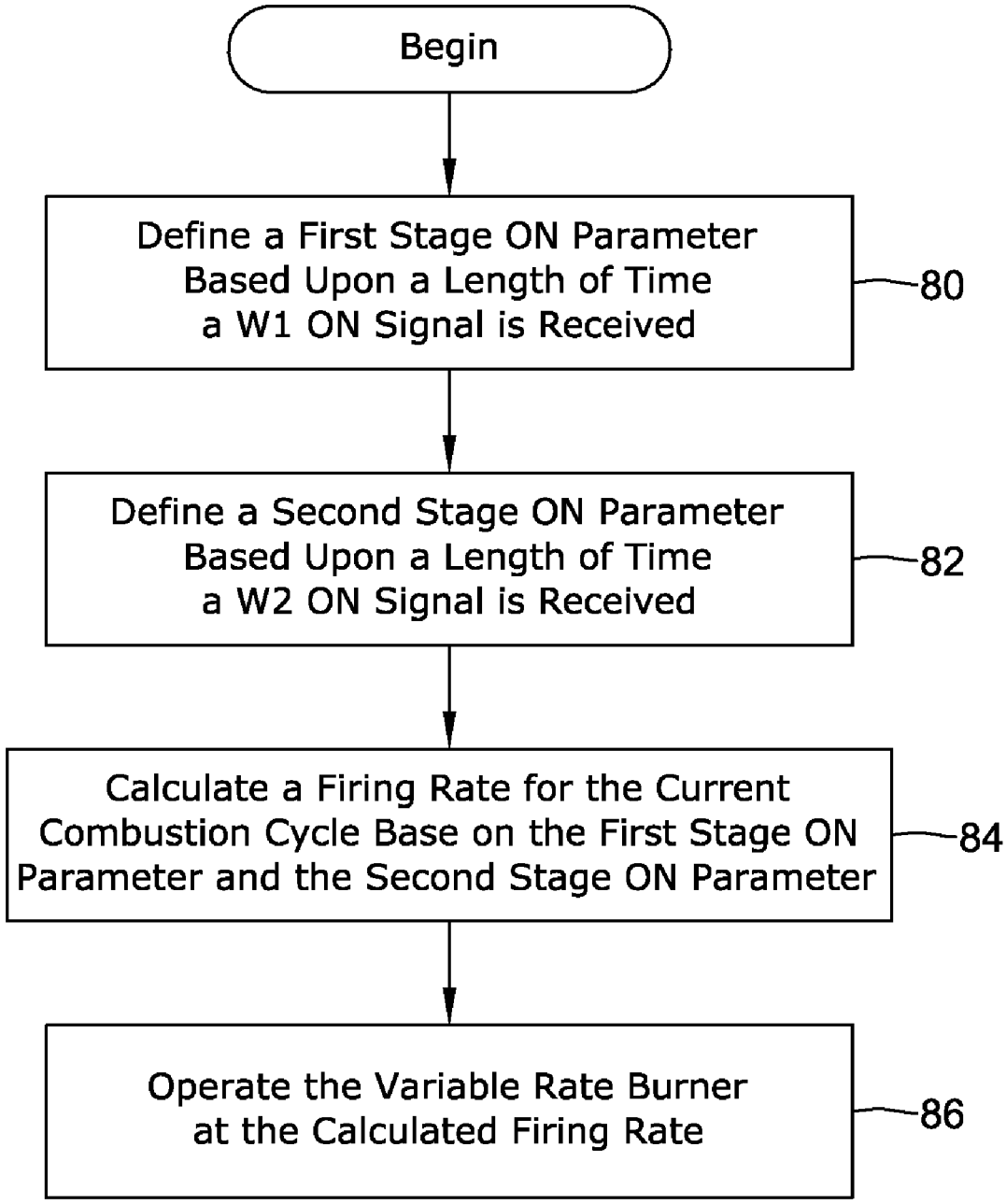

Turning now to FIG. 10, control begins at block 80, where controller 42 (FIG. 1) defines a first stage ON parameter that is based upon a length of time that a W1 (first stage heat) ON signal is received by controller 42. In some cases, the first stage ON parameter tracks how long the W1 (first stage heat) ON signal is received during a current heating cycle, but this is not required. At block 82, controller 42 (FIG. 1) defines a second stage ON parameter that is based upon a length of time that a W2 (second stage heat) ON signal is received by controller 42. In some cases, the second stage ON parameter tracks how long the W2 (second stage heat) ON signal is received during the current heating cycle, but this is not required.

At block 84, controller 42 (FIG. 1) calculates a burner firing rate for the current heating cycle that is based at least in part on the second stage ON parameter, and in some cases, on the first stage ON parameter. It will be appreciated that these parameters, i.e., how long a thermostat is calling for first stage heat, how long the thermostat is calling for second stage heat, and/or how long a thermostat is calling for first stage heat relative to how long the thermostat is calling for second stage heat, may provide controller 42 with information indicative of the current heat load on the building in which furnace 10 (FIG. 1) is installed. Control passes to block 86, where burner 12 (FIG. 1) is operated at the calculated burner firing rate. It will be appreciated that the calculated burner firing rate may be recalculated as often as appropriate during a single heating cycle.

In some cases, the calculated burner firing rate may be calculated (with reference to block 84) in accordance with the formula:

$$FiringRate = W1Rate + FiringRange * \left(\frac{W2OnTime}{FurnaceOnTime}\right),$$

where FiringRate is the calculated burner firing rate, W1 Rate is a minimum burner firing rate or a burner firing rate calculated using a previous burner firing rate or the like, FiringRange is a parameter based upon a desired burner firing rate, W2OnTime is the amount of time that a W2 (second stage heat) ON signal is received during a current heating cycle, and FurnaceOnTime is a length of time the furnace is operating during the current heating cycle. In some cases, FiringRange may represent a difference between maximum burner firing rate and minimum burner firing rate, but this is not required.

Figure 11:
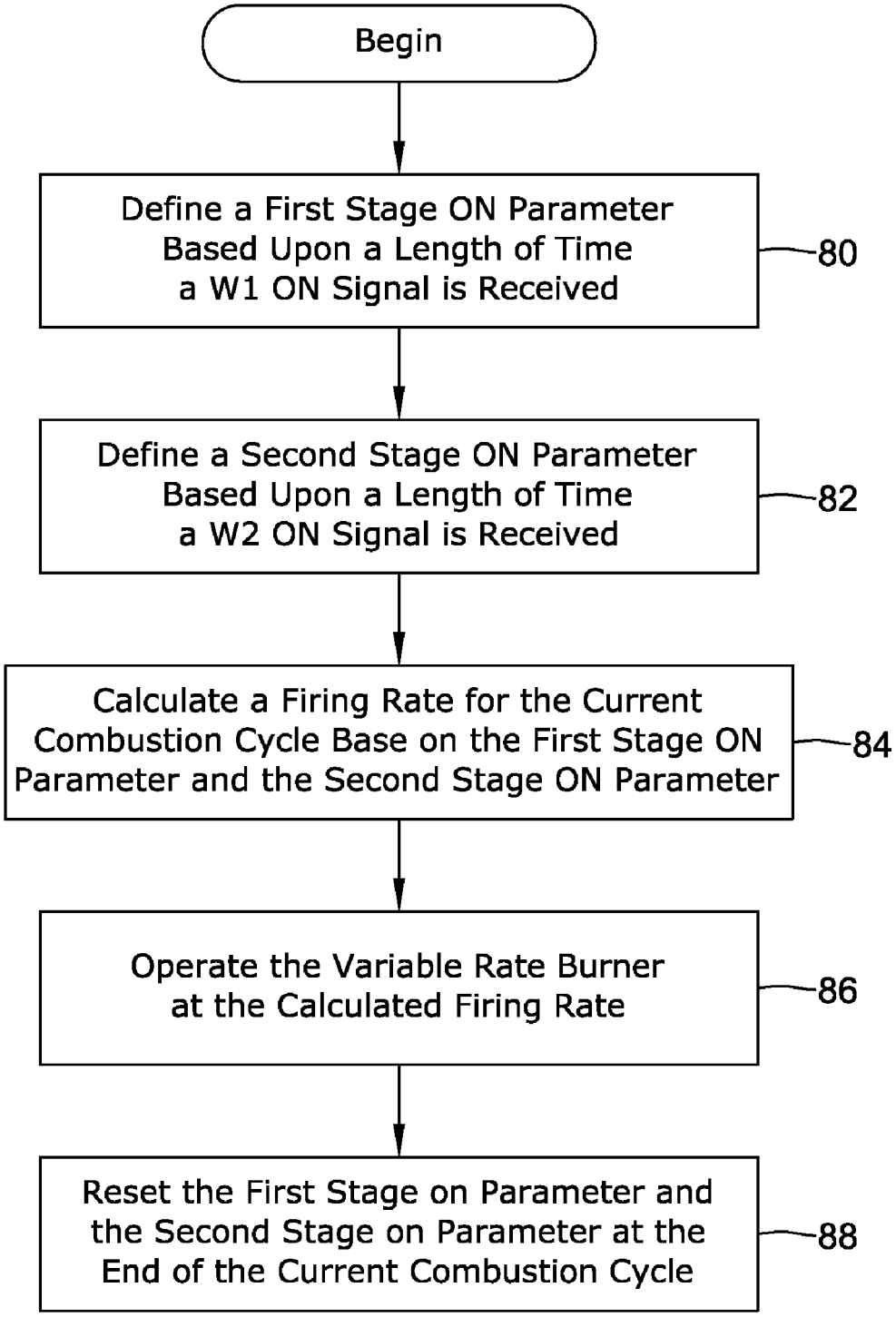

Turning now to FIG. 11, control begins at block 80, where controller 42 (FIG. 1) defines a first stage ON parameter that is based upon a length of time that a W1 (first stage heat) ON signal is received by controller 42. At block 82, controller 42 (FIG. 1) defines a second stage ON parameter that is based upon a length of time that a W2 (second stage heat) ON signal is received by controller 42. At block 84, controller 42 (FIG. 1) calculates a burner firing rate for the current heating cycle that is based at least in part on the first stage ON parameter and the second stage ON parameter.

Control passes to block 86, where burner 12 (FIG. 1) is operated at the calculated burner firing rate. It will be appreciated that the calculated burner firing rate may be recalculated as often as appropriate during a single heating cycle. At block 88, controller 42 (FIG. 1) resets the first stage ON parameter and the second stage ON parameter to zero at the end of the current heating cycle.

Figure 12:
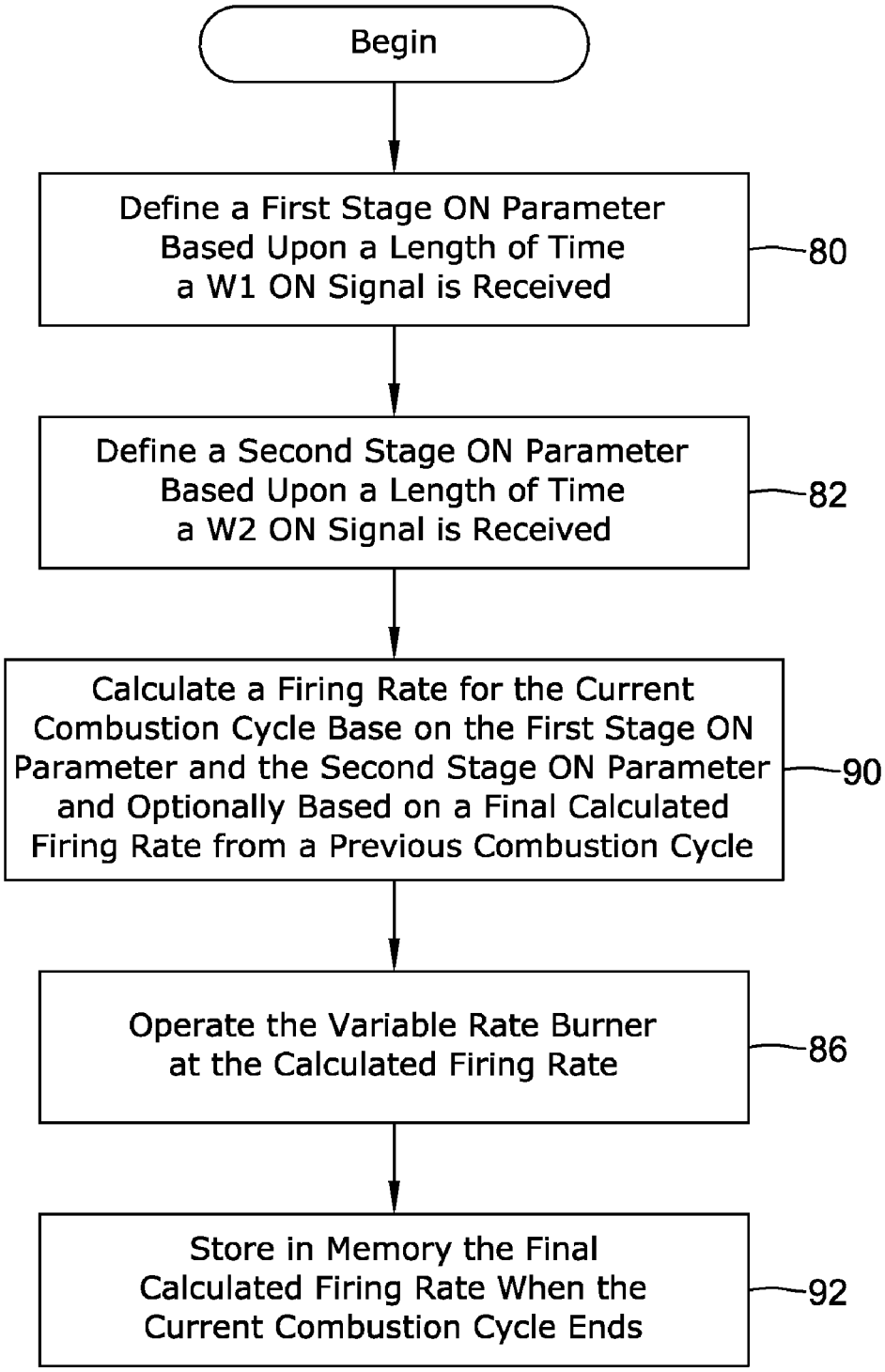

In FIG. 12, control begins at block 80, where controller 42 (FIG. 1) defines a first stage ON parameter that is based upon a length of time that a W1 first stage heat) ON signal is received by controller 42. At block 82, controller 42 (FIG. 1) defines a second stage ON parameter that is based upon a length of time that a W2 (second stage heat) ON signal is received by controller 42. At block 90, controller 42 (FIG. 1) calculates a burner firing rate for the current heating cycle that is based at least in part on the first stage ON parameter and the second stage ON parameter, and may optionally also be based upon a final calculated burner firing rate from a previous heating cycle. It will be appreciated that the calculated burner firing rate may be recalculated as often as appropriate during a single heating cycle.

Control passes to block 86, where burner 12 (FIG. 1) is operated at the calculated burner firing rate. At block 92, controller 42 (FIG. 1) stores in memory the final calculated burner firing rate when the current heating cycle ends. This value may subsequently be used, as referenced in block 90, in calculating a burner firing rate for a subsequent heating cycle.

The invention should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

We claim:

1. A method of operating a forced air furnace comprising a variable burner firing rate burner and a controller, the controller configured to accept signals from a two-stage thermostat, the method comprising the steps of:

defining a first stage ON parameter based upon a length of time a W1 (first stage heat) ON signal is asserted by the two-stage thermostat during a current heating cycle;

defining a second stage ON parameter based upon a length of time a W2 (second stage heat) ON signal is asserted by the two-stage thermostat during the current heating cycle;

calculating a burner firing rate for the current heating cycle based, at least in part, on the first stage ON parameter and second stage ON parameter; and operating the variable rate burner at the calculated burner firing rate.

2. The method of claim 1, further comprising resetting the first stage ON parameter to zero at the end of the current heating cycle.

3. The method of claim 1, further comprising resetting the second stage ON parameter to zero at the end of the current heating cycle.

4. The method of claim 1, further comprising storing a final calculated burner firing rate when a previous heating cycle ends.

5. The method of claim 4, wherein calculating the burner firing rate based on the first stage ON time and the second stage ON is also based at least in part on the stored calculated burner firing rate.

6. The method of claim 1, further comprising resetting the first stage ON parameter to zero at the end of the current heating cycle, and resetting the second stage ON parameter to zero at the end of the current heating cycle.

7. A method of operating a forced air furnace having a variable rate burner and a controller, the method comprising the steps of:

receiving a call for heat;

determining an initial burner firing rate according to the formula:

$$StartingRate = MinimumRate + \left(\begin{matrix} LastFiringRate - \\ MinimumRate \end{matrix}\right) * \frac{N}{OffTime},$$

where StartingRate is the initial burner firing rate,

MinimumRate is a predetermined minimum burner firing rate,

LastFiringRate is the burner firing rate at the end of a previous heating cycle, OffTime represents how long the burner was off just prior to receiving the call for heat, and N is a parameter that can be adjusted to further weight the StartingRate;

operating the variable rate burner at the initial burner firing rate for a predetermined period of time; and adjusting the burner firing rate after the predetermined period of time expires if the controller is still receiving a call for heat.

8. The method of claim 7, wherein the call for heat includes a W ON signal from a single-stage thermostat.

9. The method of claim 7, wherein the call for heat includes a W1 (first stage heat) ON signal from a two-stage thermostat.

10. The method of claim 9, wherein the call for heat further comprises a W2 (second stage heat) ON signal from the two-stage thermostat.

11. The method of claim 7, further comprising stopping the burner if the call for heat ceases.

12. The method of claim 7, wherein adjusting the burner firing rate after the predetermined period of time comprises increasing the burner firing rate by a determined amount at selected one or more predetermined intervals.

13. A method of operating a forced air furnace comprising a variable burner firing rate burner and a controller, the controller configured to accept signals from a two-stage thermostat, the method comprising the steps of:

defining a second stage ON parameter based upon a length of time a W2 (second stage heat) ON signal is received;

calculating a burner firing rate for a current heating cycle based, at least in part, on the second stage ON parameter;

operating the variable rate burner at the calculated burner firing rate;

wherein calculating the burner firing rate comprises calculating a burner firing rate according to the formula:

$$FiringRate = W1Rate + FiringRange * \left(\frac{W2OnTime}{FurnaceOnTime}\right),$$

where FiringRate is the calculated burner firing rate,

W1Rate is a minimum burner firing rate or a burner firing rate calculated using a previous burner firing rate, FiringRange is a parameter based upon a desired or available burner firing range, W2OnTime is the amount of time that the W2 (second stage heat) ON signal is received during the current heating cycle, and FurnaceOnTime is a length of time the furnace is operating during the current heating cycle.

* * * * *